US005706753A

United States Patent [19]

Menne et al.

[11] Patent Number: 5,706,753

[45] Date of Patent: Jan. 13, 1998

[54] BOAT COVER FASTENING SYSTEM

[75] Inventors: Timothy J. Menne; Robert J. Menne, Jr., both of Forest Lake, Minn.

[73] Assignee: Premier Marine, Inc., Wyoming, Minn.

[21] Appl. No.: 651,904

[22] Filed: May 21, 1996

[51] Int. Cl.[6] ..... B63B 17/00

[52] U.S. Cl. ..... 114/361; 296/163; 296/100

[58] Field of Search ..... 114/361; 135/87.1; 296/163, 164, 100

[56] References Cited

U.S. PATENT DOCUMENTS

| | | | |
|---|---|---|---|
| 2,198,396 | 6/1940 | Davis | 296/100 |
| 3,122,394 | 2/1964 | Brydon . | |
| 3,172,419 | 3/1965 | Lewis | 114/361 |
| 3,186,129 | 6/1965 | Blood . | |
| 3,426,400 | 2/1969 | Lauro | 24/907 |
| 3,572,353 | 3/1971 | Pinkley | 114/361 |
| 4,639,033 | 1/1987 | Wheatley et al. | 296/100 |
| 5,058,652 | 10/1991 | Wheatley et al. | 296/100 |
| 5,152,574 | 10/1992 | Tucker | 296/100 |
| 5,215,032 | 6/1993 | Ellis et al. | 114/361 |

FOREIGN PATENT DOCUMENTS

| | | | |
|---|---|---|---|
| 2198396 | 6/1988 | United Kingdom | 296/100 |

*Primary Examiner*—Jesus D. Sotelo
*Attorney, Agent, or Firm*—Hugh D. Jaeger

[57] ABSTRACT

Boat cover fastening system for aquatic craft utilizing a rail having a continuous securement channel along its length which receives a plurality of cover mounted flexible spring clips distributed along the periphery of the boat cover.

11 Claims, 5 Drawing Sheets

BOAT COVER FASTENING SYSTEM

BACKGROUND OF THE INVENTION

1. Field of the Invention

The present invention is for a cover system for an aquatic craft, and more particularly, pertains to a cover system which is readily installed on or removed from an aquatic craft.

2. Description of the Prior Art

Prior art boat cover devices have often included a snap system having a male snap member secured to a surface of the aquatic craft which mates with a corresponding female snap member secured to the canvas or plastic cover member. Initial alignment and installation of the female snap member on the cover member proved to be a demanding and time consuming task and often the mating parts were found to be out of desirable alignment when weather elements caused stretching or shrinking of the cover member. Stress points were created on the boat cover material in the area of the female snap members causing undue stress and possible separation of material at the snap. Clearly what is needed is a boat cover fastening system which is easily fabricated, which distributes stress, and which is quickly and easily installed on or removed from an aquatic craft.

The present invention overcomes the shortcomings of various prior art devices by providing a suitable boat cover fastening system.

SUMMARY OF THE INVENTION

The general purpose of the present invention is a boat cover fastening system.

According to one embodiment of the present invention, there is provided a boat cover fastening system for quick and ready securing of or removal from an aquatic craft or other vehicle, craft or device. The system includes a uniquely coupled rail and flexible spring clip system whereby a number of flexible spring clips are distributively attached along the outer periphery of a fabric boat cover and subsequently received by a continuous securement channel resident in the rail which is mounted about the edge of an aquatic or other craft such as a pontoon boat, motor boat or sailboat. The flexible spring clips are mounted in the approximate desired location along the cover periphery location but do not require exacting fabricational placement as do various prior art devices. The flexible spring clips are fashioned in one piece of plastic having a spring-like quality. Opposing members of the flexible spring clip are forced apart during insertion of an angled flexible spring clip tip into the continuous securement channel in the rail and then released to provide a captured junction between the rail and the flexible spring clip. Any number of flexible spring clips of various lengths can be used to effect a proper securement of the boat cover to the rail.

One significant aspect and feature of the present invention is a boat cover fastening system which readily attaches to or is readily removed from an aquatic craft.

Another significant aspect and feature of the present invention is a boat cover fastening system which includes a rail having a securement channel for accommodation of a flexible spring clip.

Another significant aspect and feature of the present invention is a boat cover fastening system having a flexible spring clip which engages a securement channel.

Another significant aspect and feature of the present invention is a boat cover fastening system having one or more flexible spring clips to which the boat cover is attached.

Another significant aspect and feature of the present invention is a boat cover fastening system having a plurality of flexible spring clips attached to the periphery of the boat cover.

Another significant aspect and feature of the present invention is a boat cover fastening system which is readily fabricated and which does not require exacting placement along the periphery of the boat cover during initial fabrication or custom fitting.

Another significant aspect and feature of the present invention is a boat cover fastening system which, due to the width of the flexible spring clips, distributes stress or tension in the areas of attachment to the boat cover material.

Another significant aspect and feature of the present invention is a boat cover fastening system which includes a planar member and a panel-receiving channel for accommodation of a panel.

Having thus described one embodiment of the present invention, it is the principal objective hereof to provide a boat cover fastening system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OFT HE PREFERRED EMBODIMENTS

Figure 1:
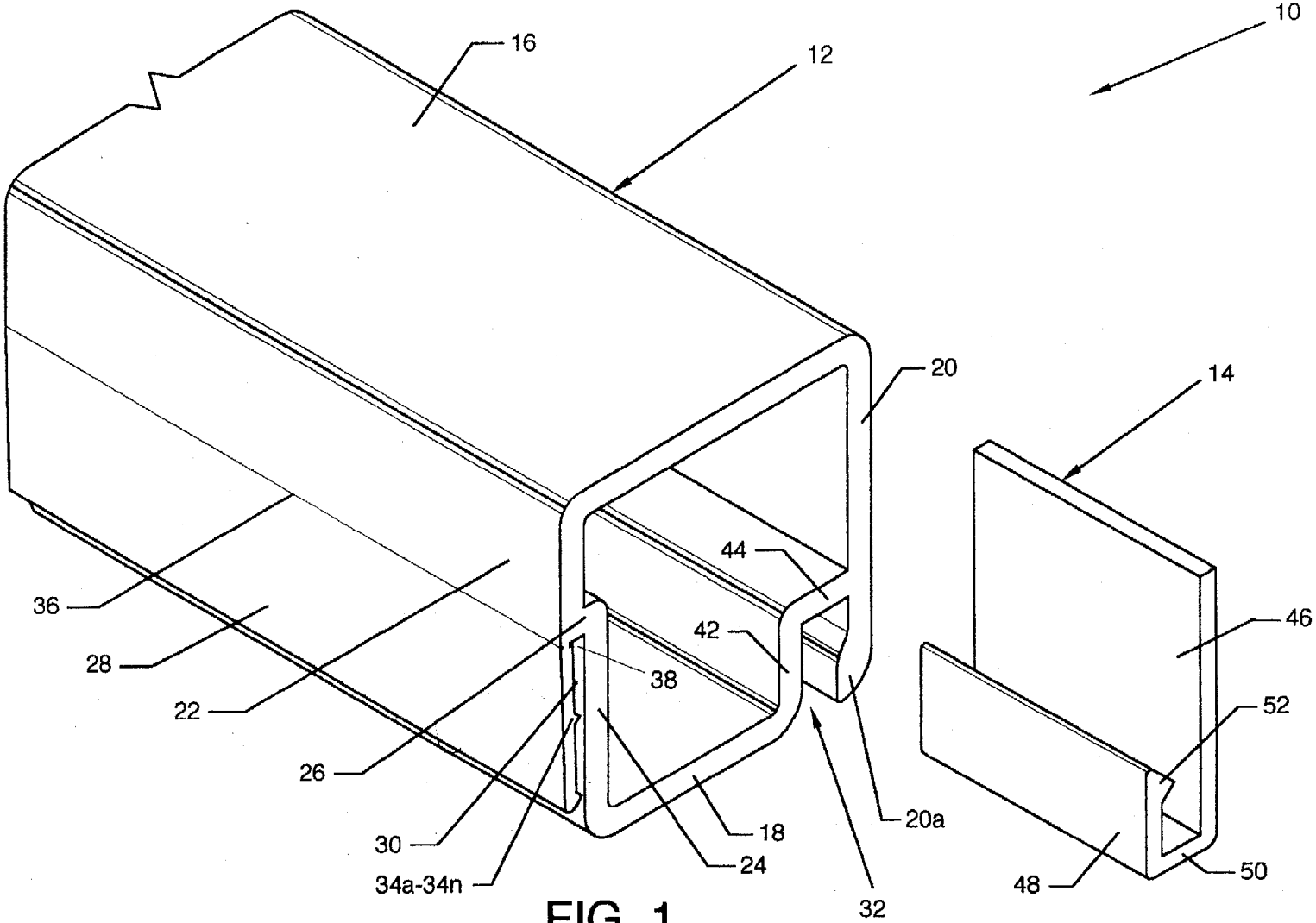
FIG. 1 illustrates an isometric view of a boat cover fastening system.

FIG. 1 illustrates an isometric view of a boat cover fastening system 10, the present invention, including a rail 12 and a flexible spring clip 14 which engages the rail 12. The rail 12 is constructed of aluminum or other suitable material in the general shape of a box tube, and includes a horizontally disposed planar top wall 16; a horizontally disposed planar bottom wall 18; an inboard sidewall extending between the planar top wall 16 and the planar bottom wall 18 and comprising a vertically disposed upper inboard planar wall member 22 joining the planar top wall 16 along a first top edge, a vertically disposed lower inboard planar wall member 24 offset inwardly from the upper inboard planar wall member 22 and joining the planar bottom wall 18 along a first bottom edge, and a horizontally disposed inboard horizontal planar wall member 26 connecting the upper inboard planar wall member 22 to the lower inboard planar wall member 24 at a location spaced upwardly from the planar bottom wall 18; an outboard sidewall extending between the planar top wall 16 and the planar bottom wall 18 and comprising a vertically disposed upper outboard planar wall member 20 joining the planar top wall 16 along a second top edge, a vertically disposed lower outboard planar wall member 42 offset inwardly from the upper outboard planar wall member 20 and joining the planar bottom wall 18 along a second bottom edge, and a horizontally disposed outboard horizontal planar wall member 44 connecting the upper outboard planar wall member 20 to the lower outboard planar wall member 42 at a location spaced upwardly from the planar bottom wall 18; a vertically aligned planar member 28 extending downwardly from the junction of the upper inboard planar wall member 22 and the inboard horizontal planar wall member 26 and having an exterior surface lying in the same plane as the outer surface of the upper inboard planar wall member 22 and an interior surface spaced from the lower inboard planar wall member 24; a panel-receiving channel 30 defined by the planar member 28, the lower inboard planar wall member 24, and the inboard horizontal planar wall member 26 for accommodation of a panel; and a configured securement channel 32 formed by an extension 20*a* of the upper outboard planar wall member 20, the lower outboard planar wall member 42, and the outboard horizontal planar wall member 44. The extension 20*a* of the upper outboard planar wall member 20 terminates in an enlarged tip with a rounded surface 66 which curves inwardly toward the lower outboard planar wall member 42 at the entrance to the securement channel 32. The extension 20*a* also includes a ramped surface 68 located within the securement channel 32 and which tapers upwardly and outwardly.

Planar member 28 includes one or more ridge lines 34*a*–34*n* extending inwardly into the panel-receiving channel 30 for securing a panel. A score line 36 marking the division of the upper inboard planar wall member 22 and the planar member 28 and an undercut 38 at the junction of the inboard horizontal planar wall member 26 and the planar member 28 provide a living hinge to facilitate movement of the planar member 28 to accommodate a panel illustrated in FIG. 5. Securement channel 32 accommodates and snappingly engages flexible spring clip 14.

Flexible spring clip 14 is formed in one piece of flexible plastic, or other such suitable material. The one-piece flexible spring clip 14 includes opposing vertically oriented spaced apart planar first and second legs 46 and 48 joined by an interceding horizontally aligned planar bight portion 50. The legs 46 and 48 extend substantially perpendicularly from the planar bight portion 50 and terminate in free ends. The legs 46 and 48 together with the planar bight portion 50 define a channel opening in the direction of the free ends of the legs. As illustrated, leg 46 is longer than leg 48, thereby giving the flexible spring clip a "J" shape. An engaging portion in the form of an angle portion 52 is included at the free end of planar leg 48 to facilitate entry of the planar leg 48 into the securement channel 32, as later described in detail.

Figure 2:
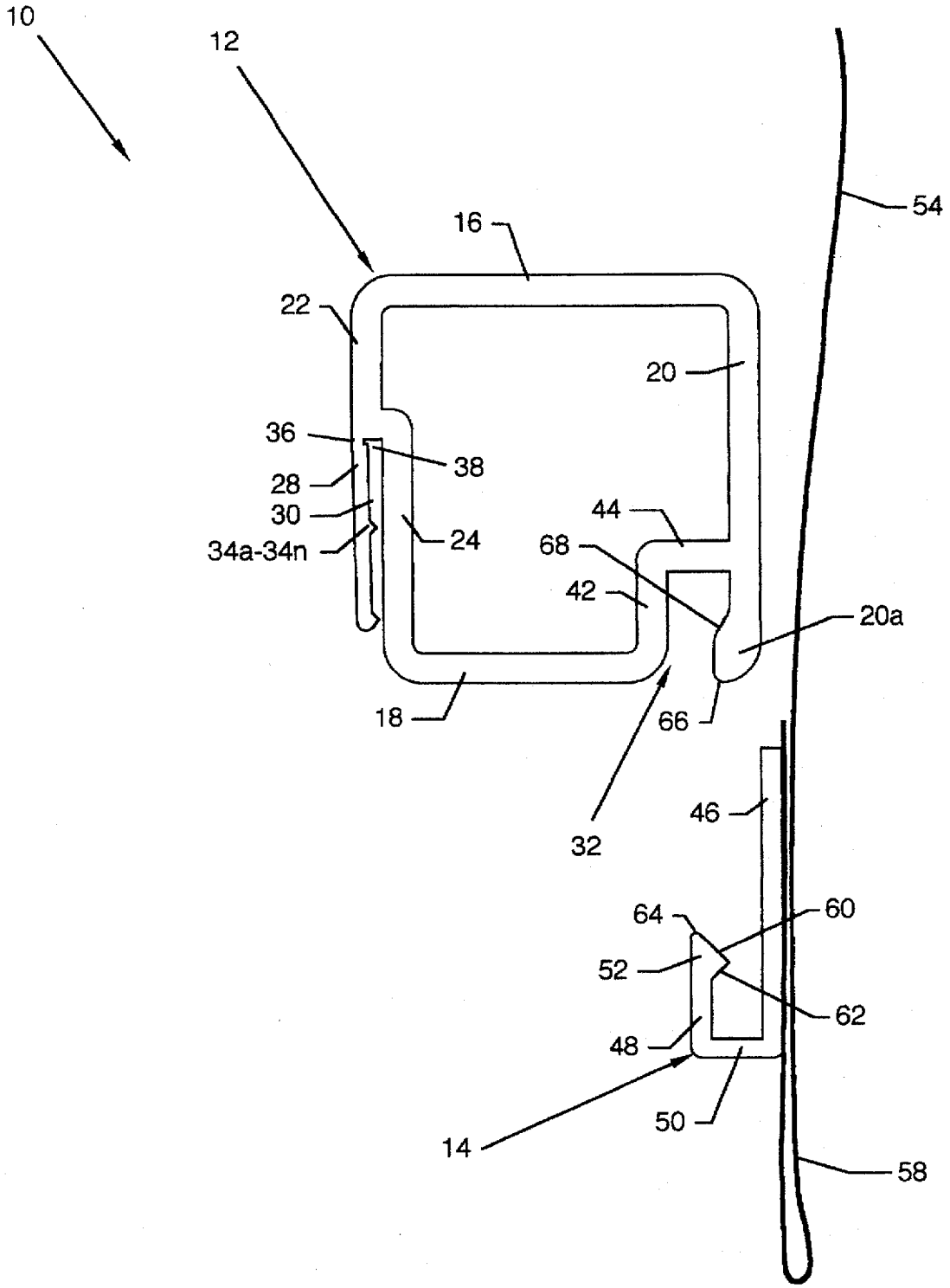
FIG. 2 illustrates an end view of a rail and a flexible spring clip prior to mutual engagement.

FIG. 2 illustrates an end view of the rail 12 and the flexible spring clip 14 prior to mutual engagement where all numerals correspond to those elements previously described. One end of a boat cover 54 of canvas, plastic or other suitable material is secured along the length of the flexible spring clip 14 in double back fashion to the leg 46 of the flexible spring clip 14 such as by stitching, glue bonding, electronic welding or other such suitable fastening means. Material extends below the flexible spring clip 14 to serve as a looped gripping member 58 to aid in insertion or removal of the flexible spring clip 14 into or from the securement channel 32 of the rail 12. The angled portion 52 of the flexible spring clip 14 includes upper and lower angled surfaces 60 and 62 which assist in inward or outward flexing of the planar legs 46 and 48 with respect to each other across planar bight portion 50 for insertion or removal of the flexible spring clip 14 into or out of the securement channel 32 of the rail 12. A rounded surface 64 is also included at the junction of upper angled surface 60 and the outer surface of planar leg 48 to assist insertion of the angle portion 52 into securement channel 32 if required. A rounded surface 66 is included at the end of the curved enlarged tip of extension 20*a* to assist in insertion of the angle portion 52 into the securement channel 32 if required. A ramped surface 68 tapering upwardly and inwardly aligns on the inner surface of the curved enlarged tip of extension 20*a* to assist in removal of the flexible spring clip 14 from the securement channel 32 of the rail 12.

Figure 3:
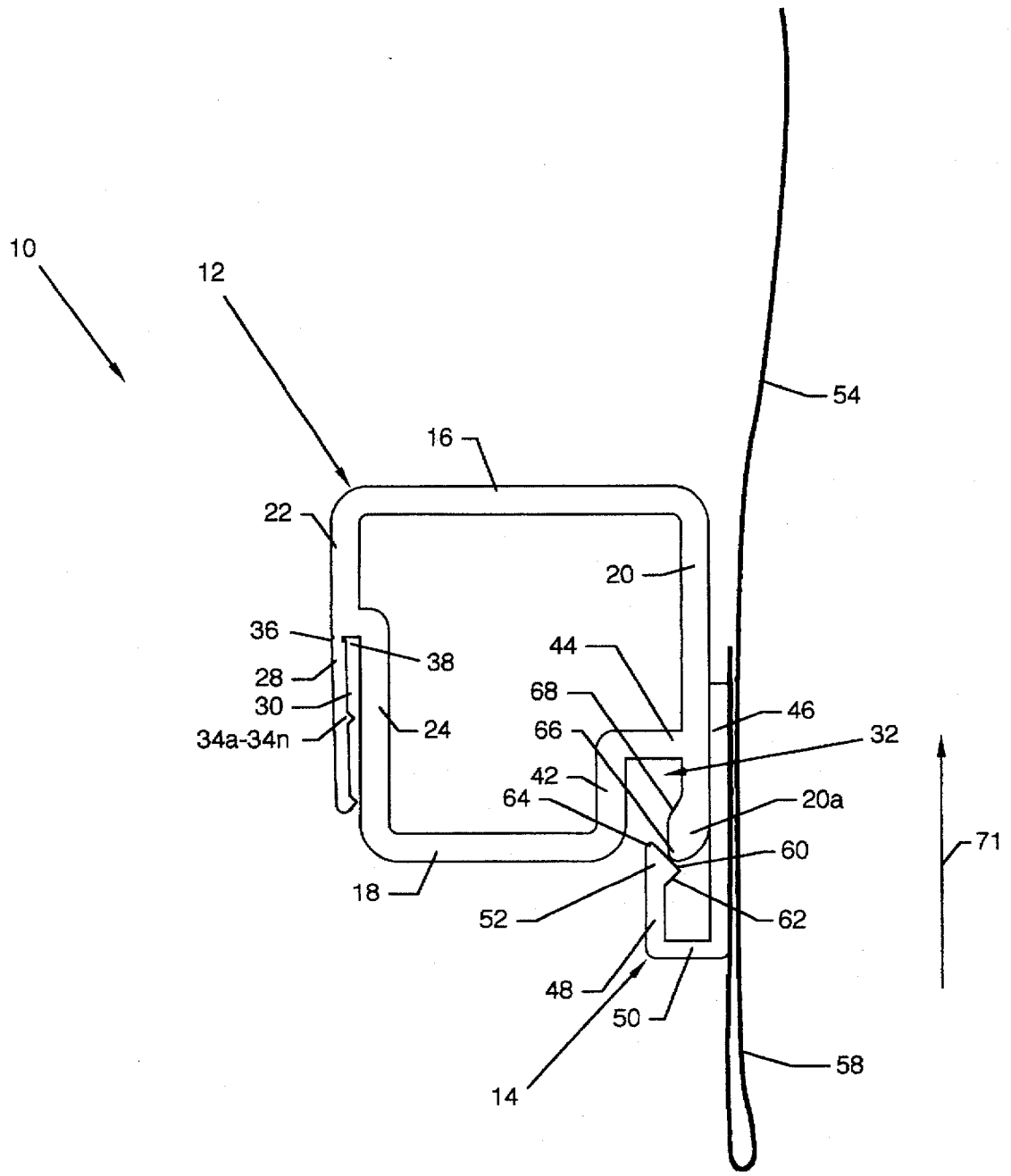
FIG. 3 illustrates an end view of the rail and the flexible spring clip during insertion prior to mutual engagement.

FIG. 3 illustrates an end view of the rail 12 and the flexible spring clip 14 during insertion prior to mutual engagement where all numerals correspond to those elements previously described. Upper angled surface 60 of the angle portion 52 contacts the rounded surface 66 of the curved enlarged tip of extension 20*a* as the flexible spring clip 14 is manually positioned upwardly, as shown by arrow 71, with respect to the rail 12, during the insertion process. During this upward movement, the opposing planar legs 46 and 48 of the flexible spring clip 14 are forced apart about the common planar bight portion 50 to allow further vertical positioning of the members of flexible spring clip 14 about and within the members of the securement channel 32. Upper and lower angled surfaces 60 and 62 form a sawtooth configuration. Surfaces 66 and 68 meet at an acute angle, thereby forming a locking or engaging hump behind which the angle portion 52 engages. Other like or similar engaging geometries can be utilized within the teachings of this present invention.

Figure 4:
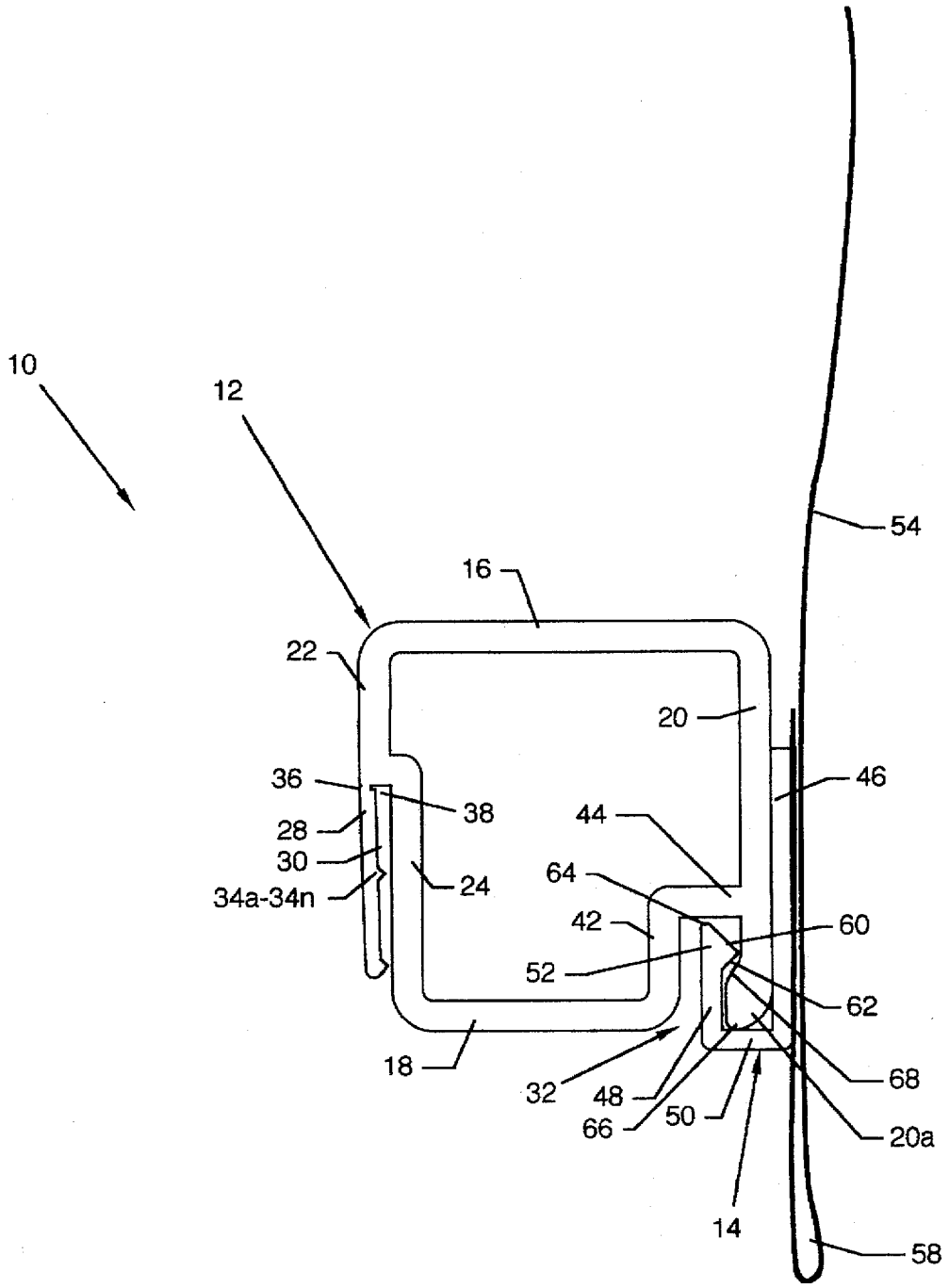
FIG. 4 illustrates an end view of the rail and the flexible spring clip in full mutual engagement; and, FIG. 5 illustrates the use of the boat cover fastening system secured to a rail structure on a deck of a pontoon boat or other watercraft.

FIG. 4 illustrates an end view of the rail 12 and the flexible spring clip 14 in full mutual engagement where all numerals correspond to those elements previously described. The angle portion 52 and a major portion of the planar leg 48 are shown inserted into and captured by the securement channel 32; moreover, the curved enlarged tip of 20*a* is encompassed in secure engagement by the members of the flexible spring clip 14. Planar leg 46, including the secured boat cover 54, is held to the upper outboard planar wall member 20.

MODE OF OPERATION

Figure 5:
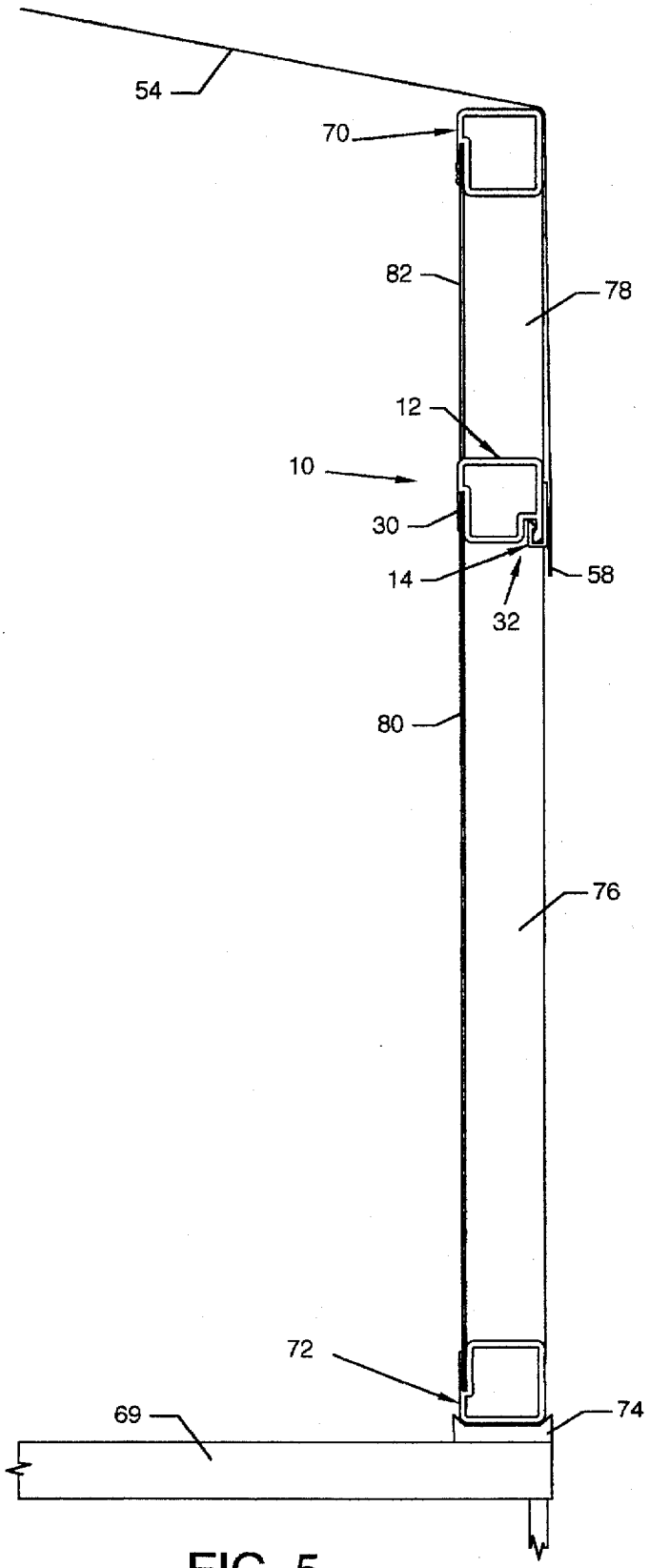

FIG. 5 illustrates the use of the boat cover fastening system 10 with various other rail members secured to the deck 69 of a pontoon boat or other watercraft where all numerals correspond to those elements previously described. The rail 12 is illustrated in conjunction with upper and lower rails 70 and 72. Rail members 70 and 72 each have a profile shape similar to that of the rail 12, however a channel, such as securement channel 32 is not necessarily included in the upper and lower rails 70 and 72. However, a rail, such as rail 12 or variations of rail 12, could be incorporated at an upper or lower position to accommodate full or partial covering along the side rails of a watercraft or other craft as desired. A mounting channel 74 serves as an intermediate mounting structure between the deck 69 and the lower rail 72. The horizontally mounted rails 12, 70 and 72 mount to a plurality of vertically oriented members 76 and 78 having similar shapes and features found on the upper and lower rail members 70 and 72. Panel 80 secures in panel-receiving channel 30 of the rail 12 and a corresponding inverted space in the lower rail 72. A panel 82 secures in a space in the upper rail 70 and extends to the rail 12. The flexible spring clip 14 is illustrated in engagement with securement channel 32 of the rail 12. A plurality of flexible spring clips 14 are located at appropriate distances along the looped gripping member 58 so that the boat cover 54 may be held and fastened at appropriate intervals as required along the rails to maintain proper tensioning of the boat cover 54.

BOAT COVER FASTENING SYSTEM

Parts List

10 boat cover fastening system 52 angle portion

12 rail 54 boat cover

14 flexible spring 58 looped gripping clip member

16 planar top wall 60 upper angled surface

18 planar bottom wall 62 lower angled surface

20 upper outboard 64 rounded surface planar wall member 66 rounded surface

**20*a* extension 68** ramped surface

22 upper inboard 69 deck planar wall member

70 upper rail

24 lower inboard planar wall member 71 arrow

26 inboard horizontal 72 lower rail planar wall member

74 mounting channel

28 planar member

76 vertical member

30 panel-receiving 78 vertical member channel

80 panel

32 securement channel 82 panel

**34*a–n*** ridge lines

36 score line

38 undercut

42 lower outboard planar wall member

44 outboard horizontal planar wall member

46 planar first leg

48 planar second leg

50 planar bight portion

Various modifications can be made to the present invention without departing from the apparent scope hereof.

We claim:

1. An elongated rail comprising:

a. a top wall, a bottom wall, an inboard sidewall, and an outboard sidewall;

b. said inboard sidewall joining said top wall along a first top edge, and said inboard sidewall joining said bottom wall along a first bottom edge;

c. said outboard sidewall including an upper outboard wall member joining said top wall along a second top edge, a lower outboard wall member offset inwardly from said upper outboard wall member and joining said bottom wall along a second bottom edge, and an outboard horizontal wall member connecting said upper outboard wall member to said lower outboard wall member at a location spaced upwardly from said bottom wall;

d. said upper outboard wall member having an extension protruding beyond said outboard horizontal wall member in the direction of said bottom wall and defining with said outboard horizontal wall member and said lower outboard wall member a securement channel; and, e. said extension terminating in an enlarged tip which has a rounded surface at the entrance to said securement channel and a ramped surface located within said securement channel, said ramped surface tapering upwardly and outwardly.

2. The elongated rail as defined in claim 1, wherein said inboard sidewall includes an upper inboard wall member, a lower inboard wall member offset inwardly from said upper inboard wall member, and an inboard horizontal wall member connecting said upper inboard wall member to said lower inboard wall member at a location spaced upwardly from said bottom wall.

3. The elongated rail as defined in claim 2, wherein each of said top wall, said bottom wall, said upper outboard wall member, said lower outboard wall member, said outboard horizontal wall member, said upper inboard wall member, said lower inboard wall member, said inboard horizontal wall member, and said extension, except for the enlarged tip, thereof, is planar.

4. The elongated rail as defined in claim 2, wherein said upper inboard wall member is planar and wherein a planar member joins said planar upper inboard wall member and extends downwardly therefrom, said planar member being spaced from said lower inboard wall member and forming with said lower inboard wall member and said inboard horizontal wall member a panel-receiving channel.

5. The elongated rail as defined in claim 4 and further including an exterior score line in said planar member at the location where said planar member joins said planar upper inboard wall member, and an undercut in said planar member within said panel-receiving channel directly opposite said exterior score line, said exterior score line and said undercut providing a living hinge.

6. The elongated rail as defined in claim 4, wherein said planar member has at least one ridge line extending along the length thereof and protruding into said panel-receiving channel.

7. The elongated rail as defined in claim 4, wherein the exterior surface of said planar upper inboard wall member and the exterior surface of said planar member lie in a common plane.

8. The elongated rail as defined in claim 1, wherein said top wall, said bottom wall, said inboard sidewall, and said outboard sidewall define a tube.

9. In combination, a rail and a flexible spring clip of a boat cover fastening system comprising:

a. an elongated rail including, (1) a top wall, a bottom wall, an inboard sidewall, and an outboard sidewall;

(2) said inboard sidewall joining said top wall along a first top edge, and said inboard sidewall joining said bottom wall along a first bottom edge;

(3) said outboard sidewall including an upper outboard wall member joining said top wall along a second top edge, a lower outboard wall member offset inwardly from said upper outboard wall member and joining said bottom wall along a second bottom edge, and an outboard horizontal wall member connecting said upper outboard wall member to said lower outboard wall member at a location spaced upwardly from said bottom wall;

(4) said upper outboard wall member having an extension protruding beyond said outboard horizontal wall member in the direction of said bottom wall and defining with said outboard horizontal wall member and said lower outboard wall member a securement channel; and, (5) said extension terminating in an enlarged tip which has a rounded surface at the entrance to said securement channel and a ramped surface located within said securement channel, said ramped surface tapering upwardly and outwardly; and, b. a flexible spring clip comprising a one-piece flexible member having two legs joined by a bight portion and extending in the same direction from said bight portion, one of said legs having an engaging portion extending toward the other of said legs for entering into said securement channel of said rail and engaging behind said ramped surface within said securement channel.

10. In combination, a flexible spring clip and a rail of a boat cover fastening system comprising:

a. a flexible spring clip including, (1) a one-piece member formed of flexible material and having a bight portion with opposite ends, a first leg connected at one end to one end of said bight portion and extending substantially perpendicularly from said bight portion and terminating in a free end, and a second leg connected at one end to the other end of said bight portion and extending substantially perpendicularly from said bight portion in the same direction as said first leg and terminating in a free end;

(2) said first and second legs together with said bight portion forming a channel opening in the direction of said free ends; and, (3) said free end of said second leg having a rounded surface at its tip and an angle portion comprising an upper angled surface extending from said rounded surface forwardly and downwardly into said channel, and a lower angled surface extending from said upper angled surface rearwardly and downwardly, said upper and lower angled surfaces meeting at an acute angle, thereby forming a sawtooth configuration; and, b. an elongated rail having a securement channel dimensioned to receive said second leg and angle portion of said flexible spring clip.

11. In combination, a rail and a flexible spring clip of a boat cover fastening system comprising:

a. an elongated rail including, (1) a top wall, a bottom wall, an inboard sidewall, and an outboard sidewall;

(2) said inboard sidewall joining said top wall along a first top edge, and said inboard sidewall joining said bottom wall along a first bottom edge;

(3) said outboard sidewall including an upper outboard wall member joining said top wall along a second top edge, a lower outboard wall member offset inwardly from said upper outboard wall member and joining said bottom wall along a second bottom edge, and an outboard horizontal wall member connecting said upper outboard wall member to said lower outboard wall member at a location spaced Upwardly from said bottom wall;

(4) said upper outboard wall member having an extension protruding beyond said outboard horizontal wall member in the direction of said bottom wall and defining with said outboard horizontal wall member and said lower outboard wall member a securement channel; and, (5) said extension terminating in an enlarged tip which has a rounded surface at the entrance to said securement channel and a ramped surface located within said securement channel, said ramped surface tapering upwardly and outwardly; and, b. a flexible spring clip including, (1) a one-piece member formed of flexible material and having a bight portion with opposite ends, a first leg connected at one end to one end of said bight portion and extending substantially perpendicularly from said bight portion and terminating in a free end, and a second leg connected at one end to the other end of said bight portion and extending substantially perpendicularly from said bight portion in the same direction as said first leg and terminating in a free end;

(2) said first and second legs together with said bight portion forming a channel opening in the direction of said free ends; and, (3) said free end of said second leg having a rounded surface at its tip and an angle portion comprising an upper angled surface extending from said rounded surface forwardly and downwardly into said channel, and a lower angled surface extending from said upper angled surface rearwardly and downwardly, said upper and lower angled surfaces meeting at an acute angle, thereby forming a sawtooth configuration; and wherein, c. said securement channel of said rail and said flexible spring clip are dimensioned such that said second leg of said flexible spring clip including said angle portion thereof is receivable into said securement channel of said rail and said angle portion is capturable by said enlarged tip of said extension of said upper outboard wall member of said rail.

* * * * *